United States Patent [19]

Christopoulos

[11] 4,040,274

[45] Aug. 9, 1977

[54] KNIT, TUCK AND WELT CAMS FOR CIRCULAR KNITTING MACHINES

[75] Inventor: John Christopoulos, Charlotte, N.C.

[73] Assignee: The Singer Company, New York, N.Y.

[21] Appl. No.: 696,090

[22] Filed: June 14, 1976

[51] Int. Cl.[2] ..... D04B 15/32

[52] U.S. Cl. ..... 66/57

[58] Field of Search ..... 66/57, 78, 50 R, 50 A

[56] References Cited

U.S. PATENT DOCUMENTS

| | | | |
|---|---|---|---|
| 1,970,238 | 8/1934 | Kretsor | 66/50 A |
| 2,618,944 | 11/1952 | Feineman | 66/57 |
| 3,310,962 | 3/1967 | Mahlen et al. | 66/57 X |
| 3,696,641 | 10/1972 | Sumitomo | 66/57 X |
| 3,726,111 | 4/1973 | Negri | 66/50 R X |

*Primary Examiner*—Mervin Stein
*Assistant Examiner*—Andrew M. Falik
*Attorney, Agent, or Firm*—Edward L. Bell; Robert E. Smith; William V. Ebs

[57] ABSTRACT

A cam section block is provided with variously arranged flat and angular needle controlling cam members, one arrangement of which is effective to cause needles moving relative to the cam section block to knit, another arrangement of which will cause needles to tuck and still another arrangement of which will cause needles to welt.

5 Claims, 8 Drawing Figures

Fig. 5
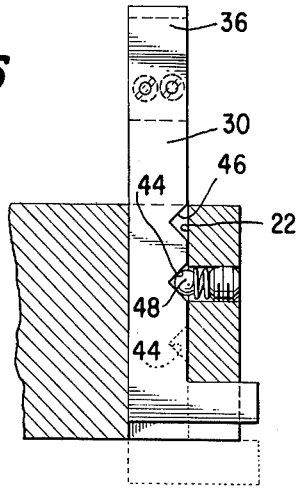
Fig. 6
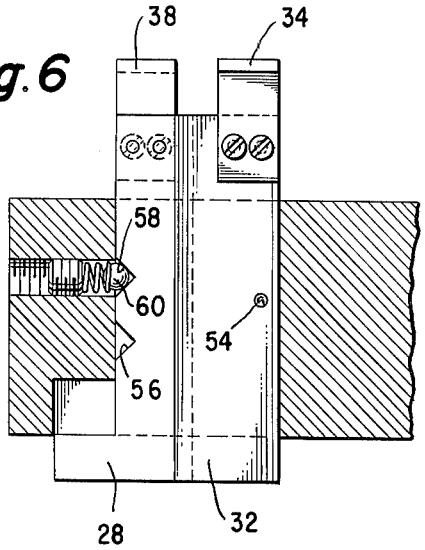
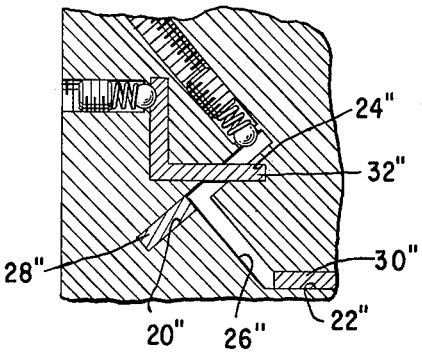
Fig. 7
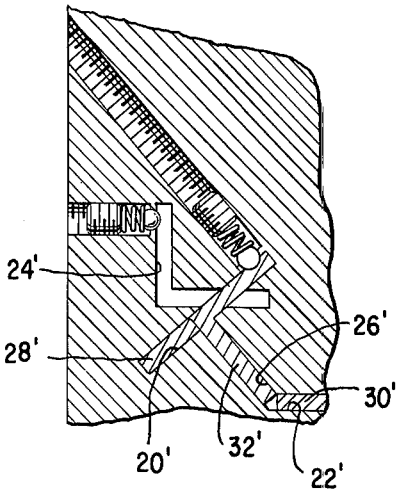
Fig. 8

KNIT, TUCK AND WELT CAMS FOR CIRCULAR KNITTING MACHINES

BACKGROUND OF THE INVENTION

1. Field of the Invention

The invention relates to needle controlling camming which is supported on the cam section blocks of a circular knitting machine.

2. Description of the Prior Art

It is conventional practice to provide circular knitting machines with knit, tuck and welt cams, each of a different shape, and to secure these cams with suitable fastening means to cam section blocks as required for controlling needles in a desired manner during the operation of the machine. Such cams and the cam section blocks to which they are affixed are shown for example in U.S. Pat. No. 3,614,877 of J. Radin issued Oct. 26, 1971.

SUMMARY OF THE INVENTION

It is a prime object of the invention to simplify the construction of the cam members used to cause needles to kit, tuck or welt in a circular knitting machine and to provide for the easy adjustment or placement and removal of such cam members in cam section blocks located around the cylinder of the machine. Cam members of only two different shapes slidably mounted in a cam section block serv to cause needles to knit, tuck or welt. The cam members have simple geometric shapes (angular and flat) and may therefoe be inexpensively produced.

DESCRIPTION OF THE DRAWINGS

FIG. 5 is a sectional view taken on the plane of the line 5—5 of FIG. 2;

FIG. 6 is a sectional view taken on the plane of the line 6—6 of FIG. 2;

FIG. 7 is fragmentary sectional view taken on the plane of the line 7—7 of FIG. 1; and FIG. 8 is a fragmentary sectional view taken on the plane of the line 8—8 of FIG. 1.

DESCRIPTION OF THE PREFERRED EMBODIMENT

Figure 1:
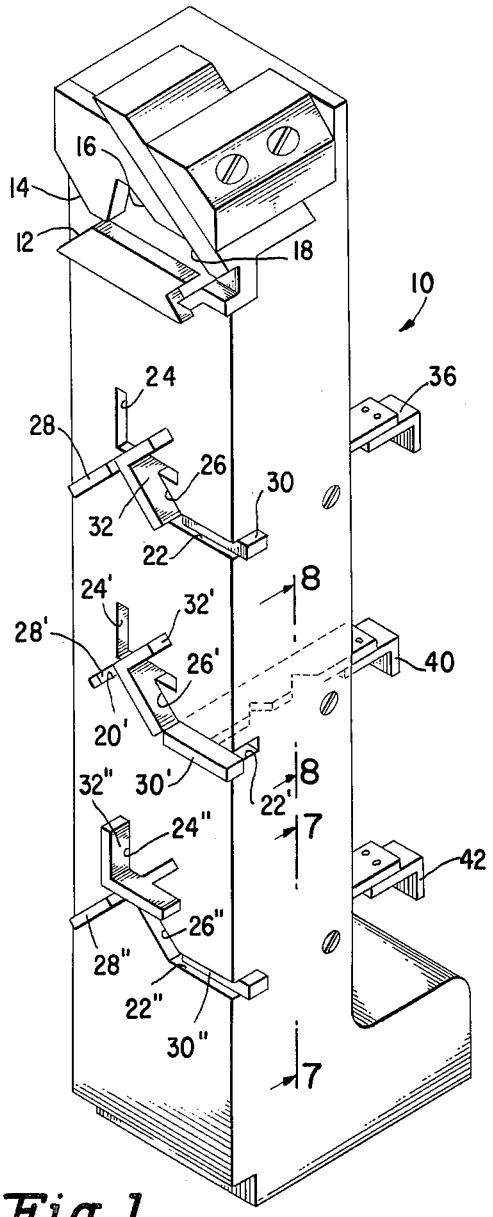
FIG. 1 is a perspective view of a cam section block provided with flat and angular needle controlling cam members according to the invention.
Figure 2:
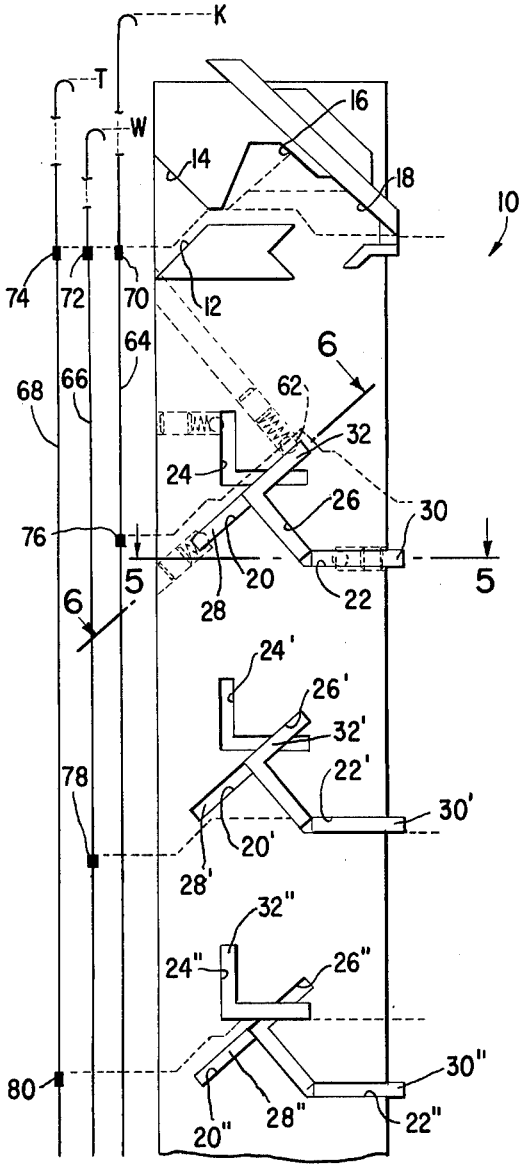
FIG. 2 is a front elevational view of the cam section block of FIG. 1.
Figure 3:
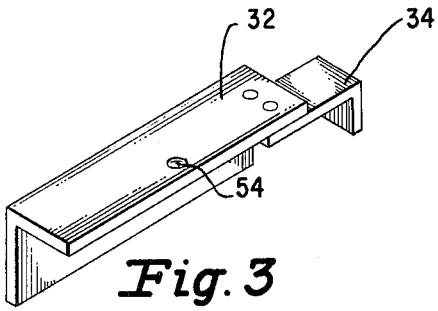
FIG. 3 is a perspective view showing an angular cam member according to the invention.
Figure 4:
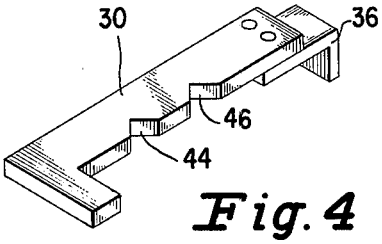
FIG. 4 is a perspective view showing a flat welt guard cam member according to the invention.

Referring to the drawings, reference character 10 designates a cam section block for a circular knitting machine. As shown, such section block supports a preliminary raise cam 12, guard cams 14 and 16, and a stitch cam 18.

In accordance with the invention, section block 10 is provided with through slots to receive angular and flat needle controlling cam members. Preferably the slots are provided at a plurality of levels on the cam section block and include at each level a straight slot for a flat raise cam member, a straight slot for a flat welt guard cam member, and a pair of two legged angular slots for an angular main cam member. As shown section block 10 is provided with slots 20, 20', and 20'' for the flat raise cam members, and slots 22, 22' and 22'' for the flat welt cam members. Slots 24 and 26, 24' and 26', 24'' and 26' are provided for the angular main cam members.

Raise cam members 28, 28' and 28'' are shown in slots 20, 20' and 20'', and welt cam members 30, 30' and 30'' in slots 22, 22' and 22'' respectively. Main cam members 32, 32' and 32'' are shown in angular slots 26, 26' and 24'' respectively, the other angular slots 24, 24' and 26'' being empty. The raise cam members and welt cam members are disposable in either of two positions in the cam section block, an active position wherein they may engage needle butts and a retracted position wherein they are withdrawn from the path of needle butts. The angular main cams are disposable in an active needle butt engageable position and may be readily removed from the section block when desired. Each of the cam members has a right-angle tab secured thereon at one end, such as tabs 34, 36, 38, 40 and 42 on cam members 32, 30, 28, 30' and 30'', which may be grasped with the fingers and used to slide the cam member in the section block.

The flat raise cams and flat welt guard cams each include a pair of notches in one edge of an elongated portion engageable with a spring biased ball, as the notches 44 and 46 on cam member 30 engageable with ball 48, and the notches 56 and 58 on cam member 28 engageable with ball 60. When a notch nearest the right-angle tab on a flat raise or welt guard cam member is engaged by a ball check device the cam member is in a needle butt engageable position, (the position of cam members 28, 30' and 28''), whereas when the other notch is engaged, the cam member is in its inactive position (the position of cam members 30, 28' and 30''). The angular main cam members include a recess engageable by a spring biased ball, as the recess 54 in one leg of cam member 32 engageable by ball 62. An angular main cam is disposed in its needle butt engaging position (the position of angular main cam members 32, 32' and 32'') when engaged by a ball in the recess provided for it.

Needles such as 64, 66 and 68 having commonly located butts 70, 72 and 74 respectively coact with the camming on the cam section block 10. Each needle is raised slightly from a cast-off position by engagement of the common butt with preliminary raise cam 12 after which it is raised to a latch clear yarn accepting knit position, or a tuck position, or is confined to a welt position as determine by the location thereon of a second butt. As shown needle 64 has a butt 76 engageable with cam members 28 and 32 effective to raise the needle to a latch clear position (K). Needle 66 has a butt 78 engageable with cam members 32' and 30' effective to confine the needle to welt height (W), and needle 68 has a butt 80 engageable with cam members 28'' and 32'' effective respectively to raise and hold the needles to a tuck position (T). All needles are lowered to a cast off position by engagement of the common needle butts 70, 72 and 74 with stitch cam 18.

At any of the three levels at which flat and angular cam members are shown in section block 10, the cam members may be readily disposed to cause a needle with an appropriately placed butt to assume either a latch clear yarn engaging position, a welt position, or a tuck position. The required arrangement of the cam members at a selected level for needles to assume a predetermined position is established by disposing a raise cam member and welt guard cam member in an active and inactive position respectively or vice versa, and disposing a main cam in an active position in one of the two angular slots at such level. As previously noted the raise cam members and welt guard cam members are slidable in the section block between active and inactive positions. A main cam member in one slot may be readily moved from the section block at a particular level and replaced in an active position in the other slot at the same level as required to control needles at such level in a desired manner in conjunction with a raise cam member or welt guard cam member.

Numerous alterations of the structure herein will suggest this to those skilled in the art. It is to be understood that the present disclosure relates to a preferred embodiment of the invention which is for purpose of illustration only and is not to be construed as a limitation of the invention. All such modifications which do not depart from the spirit of the invention are to be included within the scope of the appended claims.

Having thus set forth the nature of the invention, what is claimed herein is:

1. In a cam section block, a first straight slot (20) and a first two legged angular slot (26) with the straight slot (20) and one leg of the angular slot (26) in alignment, a second straight slot (22′, 20″), a second two legged angular slot (26′, 24″)a first two legged angular cam member (32) in the first angular slot (26), a first flat plate like cam member (29) in the first straight slot (20) for acting in conjunction with one leg of the first angular cam member (32) to raise predetermined needles moving relative to the cam section to a latch clear position, a second two legged angular cam member (32′, 32″) in the second angular slot (26′, 24″), and a second flat plate like cam member (30′, 28″) in the second straight slot (22′, 20″) for acting in conjunction with one leg of the second angular cam member (32′, 32″), the second angular slot and second flat slot being disposed to cause the cams therein to control the position of other predetermined needles moving relative to the cam section in a manner different from the cam members in the said first slots (20, 26).

2. The combinations of claim 1 wherein the second angular slot (26′) and second straight slot (22′) are disposed with respect to each other so that the cam members in such second slots may cause said other needles to welt.

3. The combination of claim 1 wherein the second angular slot (24″) and the second straight slot (20″) are disposed with respect to each other so that the cam members in such second slots may cause said other needles to tuck.

4. The combination of claim 3 including a third angular slot (26′), a third straight slot (22′) an angular cam member (32′) in the third angular slot, and a flat plate like cam member (30′) in the third straight slot (22′) with the third pairs of slots so arranged that the cam members in such pair of slots may cause said other needles to welt

5. In a cam section block, a pair of straight slots (20 and 22), a two legged angular slot (26), a two legged angular cam member (32) located in the angular slot and extending into a needle butt engageable position, a plate like cam member (28 and 30) in each of the straight slots, the plate like cam members each being movable into and out of a needle butt engageable position and only one thereof being disposed in a needle butt engageable position to cooperate with the angular cam member and control needles moving relative to the cam section block, the two legged angular cam member being removably mounted in the section block and the section block including another two legged angular slot (26′, 24′) for receiving the angular cam member, the angular cam member being disposable in said another slot in a needle butt engageable position, an additional straight slot and a plate like cam member therein disposable in a needle butt engaging position to cooperate with the angular cam member in said another two legged angular slot and control needles moving relative to the cam section block.

* * * * *